US005472738A

United States Patent [19]

Novak

[11] Patent Number: 5,472,738

[45] Date of Patent: Dec. 5, 1995

[54] METHOD OF PROVIDING HEAT TRANSFER PLATES WITH A LAYER OF A SURFACE PROTECTING MATERIAL

[75] Inventor: Ladislav Novak, Lund, Sweden

[73] Assignee: Alfa Laval Thermal AB, Lund, Sweden

[21] Appl. No.: 371,607

[22] Filed: Jan. 12, 1995

Related U.S. Application Data

[63] Continuation of Ser. No. 117,144, file as PCT/SE92/00172, Mar. 20, 1992, abandoned.

[30] Foreign Application Priority Data

Mar. 25, 1991 [SE] Sweden ..... 9100889

[51] Int. Cl.[6] ..... B05D 7/02

[52] U.S. Cl. ..... 427/237; 427/238; 427/239; 427/255.6; 427/275

[58] Field of Search ..... 427/237, 238, 427/239, 255.6, 275

[56] References Cited

U.S. PATENT DOCUMENTS

| | | | |
|---|---|---|---|
| 1,894,957 | 1/1933 | Lucke et al. . | |
| 3,240,268 | 3/1966 | Armes | 165/167 |
| 3,869,300 | 3/1975 | Scheiber | 118/63 |
| 3,946,125 | 3/1976 | Scheiber | 427/181 |
| 4,042,163 | 8/1977 | Schladitz | 427/237 |
| 4,071,641 | 1/1978 | Susai | 427/238 |
| 4,351,859 | 9/1982 | Hartmann | 427/238 |
| 4,454,173 | 6/1984 | Koga | 427/237 |
| 4,518,623 | 5/1985 | Riley | 427/8 |
| 4,795,662 | 1/1989 | Kreiselmaier | 427/230 |
| 4,987,955 | 1/1991 | Bergqvist et al. | 165/167 |

FOREIGN PATENT DOCUMENTS

| | | | |
|---|---|---|---|
| 61-149794 | 7/1986 | Japan | F28F 19/04 |
| 1151546 | 4/1985 | U.S.S.R. . | |

*Primary Examiner*—Benjamin Utech

*Attorney, Agent, or Firm*—Davis Hoxie Faithfull & Hapgood

[57] ABSTRACT

The invention is a method for assembling heat transfer plates, introducing a plastic protective material into the plate interspaces as a vapor, and condensing the material on the surfaces of the heat transfer plates.

5 Claims, 1 Drawing Sheet

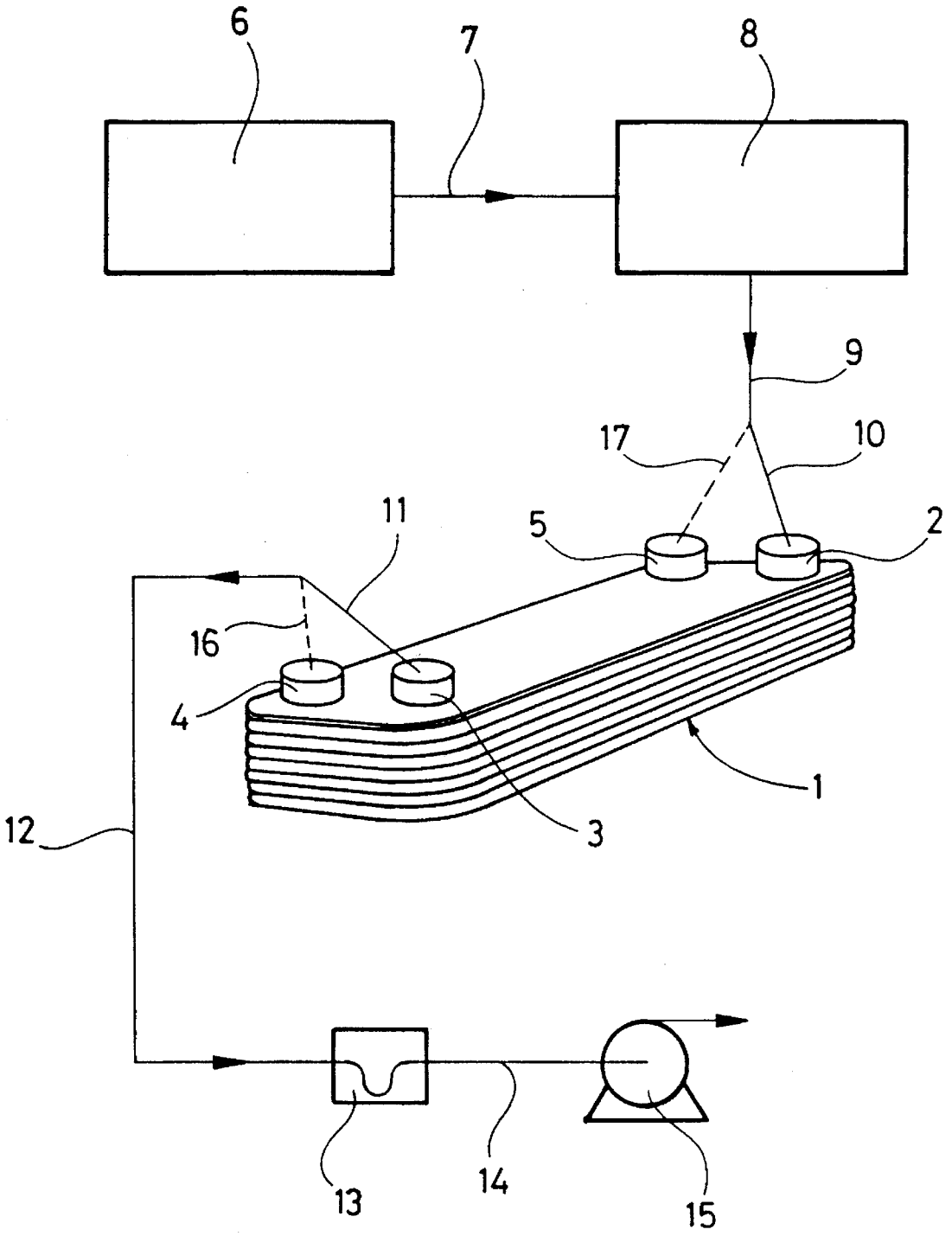
6
7
8
9
17
10
11
5
2
16
4
3
1
12
13
14
15

METHOD OF PROVIDING HEAT TRANSFER PLATES WITH A LAYER OF A SURFACE PROTECTING MATERIAL

This is a continuation of application Ser. No. 08/117,144, filed on Sep. 13, 1993, now abandoned and also International Application PCT-SE92-00172 filed on Mar. 20, 1992 and which designated the U.S.

Heat transfer plates are made of many different materials which are more or less resistant to corrosion or other influence by different heat exchange fluids. As to heat transfer plates of metal, which for a certain purpose are not sufficiently resistant to corrosion, it is technically possible, but in practice difficult, to increase the resistance to corrosion of the plates at an acceptable cost by providing the plates with an outer layer of another metal. The possibility of providing metallic heat transfer plates with a protecting layer of plastic, which would be cheaper than a layer of metal, does not seem to have been used to any large degree. This may be for several reasons.

Thus, heat transfer plates of thin sheet metal are often provided with corrugations or other protuberances in their heat transferring portions, which portions, in a plate heat exchanger, abut against each other at a high pressure at a great number of contact places distributed across the heat transferring portions. If the plates were covered by thin plastic layers, such layers would easily be broken at the said contact places.

The possibility of providing heat transfer plates intended for brazed plate heat exchangers with thin plastic layers has been excluded because such plastic layers would obviously be destroyed in the brazing together of the heat transfer plates.

BACKGROUND OF THE INVENTION

The present invention relates to a novel and inexpensive way of providing heat transfer plates with a layer of a surface protecting material, which method is characterized in that the heat transfer plates are first assembled to form a plate heat exchanger, in which plate interspaces for the through flow of two heat exchange fluids are formed, and that a gaseous medium containing the surface protecting material is then introduced into the plate heat exchanger at least in those plate interspaces being intended for through flow of one of said heat exchange fluids, the surface protecting material, in a way known per se, being caused to form a layer on the surfaces of the heat transfer plates.

The method according to the invention may be applied to any kind of plate heat exchanger but is particularly intended for plate heat exchangers having permanently assembled heat transfer plates, e.g. welded or brazed plate heat exchangers. In brazed plate heat exchangers the invention provides in addition to a surface protection for the heat transfer plates also a surface protection for the brazing material used between the heat transfer plates. This means that the field in which brazed plate heat exchangers may be used can be extended, since the brazing material sometimes constitutes an obstacle to using such heat exchangers in connection with certain liquids.

It is particularly suitable in connection with use of the invention that a plastic be used as a surface protecting material. The plastic material may be introduced into the plate heat exchanger either in the form of a mist, i.e. in the form of small liquid drops suspended in a gas, or in an evaporated form. In the latter case the gaseous medium being introduced into the plate heat exchanger may completely consist of evaporated plastic. A technique that may be used is described in the World Patents Index abstract of Patent SU 1151546, which reads as follows:

Poly-p-xylylene films and coatings are used in electrical equipment for insulation. They are made by thermal decomp. of di-p-xylylene at 450–700 deg. C., 1–100 mm Hg press. The pyrolysis products are condensed and polymerized as a layer at 15–25 deg. C. The electrical strength of coatings and films is increased by maintaining the initial layer in air, after which the condensation and polymerization processes are repeated 2–5 times.

Typically, 1 g-di-p-xylylene is placed in a sublimation chamber, the pressure is lowered to 1 mm Hg and the chamber is heated to 200 deg. C. The pyrolysis zone consists of a quartz tube, 600 mm long, dia. 18 mm, maintained at 600 deg. C. The di-p-xylylene molecule is decomposed into 2 molecules of p-xylylene, which are carried in a gas stream to the polymerization zone maintained at 25 deg. C. The process is repeated 4 times, so that 5 bonded layers are produced, thickness 20 microns, electrical strength 500 kV/mm, resistance under rupture 62 MPa, rel. elongation 21 per cent.

ADVANTAGE—The patented process raises the electrical strength of these films from 220 to 530 kV/mm, without deterioration of other characteristics. Bul. 15/23.4.85@ (2pp Dwg. No 0/0).

Thus, according to the technique described in the foregoing abstract, a substance, di-p-xylylene, may be transformed from a solid state to a gas by sublimation in a first chamber at a pressure of 1 mm Hg and a temperature of 200° C., after which the substance is subjected to pyrolysis in a second chamber at 600° C. A substance, e.g. di-p-xylylene, treated in this manner would then according to the invention be sucked into an assembled plate heat exchanger kept at a relatively low temperature. e.g. room temperature, so that the gaseous substance is condensed onto the surfaces of the heat transfer plates in the plate heat exchanger. Simultaneously, a polymerization takes place. Sucking of the gaseous plastic material into the plate heat exchanger may be performed in several steps to obtain several layers of plastic on the surfaces in question. If necessary for a sufficient covering of all the surfaces by layers of plastic, the suction of the gaseous plastic material into the plate heat exchanger may be performed alternately from the inlet and the outlet, respectively, of the plate heat exchanger for the heat exchange fluids.

BRIEF DESCRIPTION OF THE DRAWINGS

The invention will be described below with reference to the accompanying drawing in which the single FIGURE is a schematic flow diagram of a plant for covering heat transfer plates with a layer of plastic material by the method according to the invention.

DESCRIPTION OF THE PREFERRED EMBODIMENT

In the drawing there is shown a permanently assembled brazed plate heat exchanger 1 of a conventional kind, which has an inlet 2 and an outlet 3 for a first heat exchange fluid and an inlet 4 and an outlet 5 for a second heat exchange fluid. The plate heat exchanger may be for instance of the kind described more closely in WO 88/09473 or (U.S. Pat. No. 4,987,955).

The drawing shows schematically an apparatus 6 for evaporation of a plastic material. This apparatus communicates through a conduit 7 with an apparatus 8 for a pyrolysis of evaporated plastic material. The apparatus 8 in turn communicates through conduits 9 and 10 with the inlet 2 of the plate heat exchanger for said first heat exchange fluid. The plate heat exchanger outlet 3 for the same heat exchange fluid communicates through conduits 11 and 12 with a liquid trap 13 which in turn through a conduit 14 communicates with a vacuum pump 15.

Through conduits 16 and 17 —shown by dotted lines in the drawing —also the plate heat exchanger inlet 4 and outlet 5 for said second heat exchange fluid may also be connected to the conduits 12 and 9, respectively.

The shown plant is intended to operate in the following manner. The evaporating apparatus 6 is charged batchwise or continuously with a plastic material in a solid or liquid state. By means of the vacuum pump 15 a subpressure is generated in the apparatus 6 corresponding to an absolute pressure of about 1 mm Hg. When a desired subpressure prevails in the apparatus 6, this is heated to a temperature of between 150° C. and 200° C., the supplied plastic material being evaporated.

By means of the vacuum pump 15 the vapour formed in apparatus 6 is sucked through the conduit 7, which may comprise a suitable throttle, into the apparatus 8 in which there is maintained by means of the vacuum pump a subpressure corresponding to an absolute pressure of about 0,5 mm Hg. A temperature of between 600° and 700° C. prevails in the apparatus 8, so that a pyrolysis is obtained of the incoming vapour of plastic material.

By means of the vacuum pump 15 the vapour of plastic material is sucked further on through the conduit 9, which may contain a suitable throttle, and through the conduit 10 into every second plate interspace in the plate heat exchanger 1. Within these plate interspaces a subpressure corresponding to an absolute pressure of 0,1 mm Hg is maintained. The whole plate heat exchanger is kept at a relatively low temperature, e.g. room temperature, vapour condensating onto one side of each of the plates in the plate heat exchanger. Vapour also condensates onto such inner parts of the plate heat exchanger which delimit inlet and outlet channels to and from, respectively, the plate interspaces.

A certain excess amount of vapour may be sucked further on through the conduits 11 and 12 to the liquid trap in which it is condensed.

In connection with the condensation of the evaporated plastic material onto the inner surfaces of the plate heat exchanger a polymerization of the plastic material occurs, so that a continuous solid layer of plastics is formed on the surfaces.

If all of the surfaces in the plate heat exchanger are to be covered by plastic, the conduits 16 and 17 are also used. Either, all of the conduits 10, 11, 16 and 17 may be open for simultaneous through flow, or the through flow may be controlled by means of valves, not shown , that evaporated plastic material is first introduced only into every second plate interspace of the plate heat exchanger and, thereafter, evaporated plastic material is introduced only into the rest of the plate interspaces.

In a similar manner it is possible, in a plant of the kind shown in the drawing, to connect in parallel with the conduits 9 and 12 several plate heat exchangers by means of branch conduits corresponding to the conduits 10, 11, 16 and 17. If so, valves are preferably arranged at least in the branch conduits corresponding to the conduits 10 and 17, so that the different plate heat exchangers, or parts thereof, may be successively connected to the apparatus 8. In this manner a relatively small vacuum pump may be used even if a large number of heat exchangers are connected to the plant.

If valves are arranged in all of the branch conduits, i.e. even those corresponding to the conduits 11 and 16, it is possible during operation of the plant to remove treated heat exchangers successively from the plant and replace them by new heat exchangers to be treated. The plant thus may be kept in operation continuously as long as desired.

The above briefly described technique concerning evaporation, pyrolysis and condensation (polymerization) of plastic material is previously known, and no further description thereof would be necessary. Thus, technique of this kind is marketed for instance by an Italian company, Himont Italia, under the registered trade mark GALAXYL, and by two American enterprises Para Tech Coating Company and Paratronix, Inc. According to the technique thus previously known objects to be covered by a plastic layer are placed within an evacuated chamber.

The said technique is also described in the abstract of patent specification SU-A 1.151.546, as indicated above.

I claim:

1. A method for providing heat transfer plates with a layer of plastic protecting material which comprises assembling a plurality of heat transfer plates to form a plate heat exchanger having plate interspaces for the through flow of heat exchange fluids, vaporizing said protective material to bring it into the gaseous phase, introducing a gaseous medium comprising said surface protecting material in gaseous form into at least one plate interspace of said plate heat exchanger and causing said material to condense on the surfaces of the heat transfer plates forming said plate interspace.

2. Method according to claim 1, characterized in that the assembled heat exchanger is connected both to a subpressure source and to an apparatus containing said gaseous medium with the surface protecting material, the gaseous medium with the surface protecting material then being sucked into the plate interspaces of the plate heat exchanger by said subpressure source.

3. Method according to claim 1, characterized in that the heat transfer plates are assembled permanently, before the gaseous medium with the surface protecting material is introduced into the plate interspaces.

4. A method according to claim 1 wherein the heat transfer plates are brazed to join them permanently before the gaseous medium with the surface protecting material is introduced into the plate interspaces.

5. A method according to claim 1 wherein the heat transfer plates are welded to join them permanently before the gaseous medium with the surface protecting material is introduced into the plate interspaces.

* * * * *

UNITED STATES PATENT AND TRADEMARK OFFICE

CERTIFICATE OF CORRECTION

PATENT NO. : 5,472,738

DATED : December 5, 1995

INVENTOR(S) : Ladislav Novak

It is certified that error appears in the above-indentified patent and that said Letters Patent is hereby corrected as shown below:

Col. 1, before line 5, insert the heading --Background of the Invention--.

Col. 1, line 35, cancel "Background of the Invention" and insert --Summary of the Invention--.

Col. 2, line 66, cancel "WO 88/09473 or".

Col. 3, line 12, cancel "also".

Col. 3, line 47, after "trap", insert --13--.

Col. 3, line 56, after "Either", delete the comma ",".

Col. 3, line 58, before "that", insert --such--.

Signed and Sealed this

Seventh Day of January, 1997

*Attest:*

BRUCE LEHMAN

*Attesting Officer*

*Commissioner of Patents and Trademarks*